United States Patent [19]

Schmeling et al.

[11] 3,934,054

[45] Jan. 20, 1976

[54] ELECTROLESS METAL PLATING

[75] Inventors: Edith-Luise Schmeling, Cologne-Dellbruck; Herbert Friebe, Cologne-Lindenthal; Ulrich Reininghaus, Cologne-Nippes, all of Germany

[73] Assignee: Electro Chemical Engineering GmbH, Zug, Schweiz, Switzerland

[22] Filed: Dec. 3, 1973

[21] Appl. No.: 421,106

Related U.S. Application Data

[63] Continuation-in-part of Ser. No. 852,685, Aug. 25, 1969, abandoned.

[52] U.S. Cl. ..... 427/8; 118/421; 118/603; 427/437; 427/438; 427/345; 427/347

[51] Int. Cl.[2] ..... C23C 3/02

[58] Field of Search ..... 117/120 R, 130 E, 130 R, 117/101, 102 R, DIG. 8; 118/421, 603; 427/437, 438, 8, 345, 347

[56] References Cited

UNITED STATES PATENTS

| | | | |
|---|---|---|---|
| 2,865,375 | 12/1958 | Banks et al. | 117/130 E |
| 2,874,073 | 2/1959 | Metheny et al. | 117/130 E |

*Primary Examiner*—Ralph S. Kendall
*Assistant Examiner*—John D. Smith
*Attorney, Agent, or Firm*—Meyer, Tilberry & Body

[57] ABSTRACT

A method and apparatus for electroless plating of a metal on a workpiece overcomes the problem of metal plating on solid particles suspended in the solution and on those parts of the plating apparatus in contact with the solution by maintaining a concentration of anticatalytic substance, such as lead ions, between about $10^{-6}$ and $10^{-1}$ mols per liter and maintaining a relative speed of more than about 0.9 meter per second between the solution and those parts of the apparatus in contact with the solution.

15 Claims, 2 Drawing Figures

INVENTORS
Edith-Luise Schmeling, geb. Kretschmer
Herbert Friebe, Ulrich Reininghaus
BY
Meyer, Tilberry & Body

ELECTROLESS METAL PLATING

This application is a continuation-in-part of our earlier-filed copending application Ser. No. 852,685, filed Aug. 25, 1969.

The present invention pertains to the art of metal plating, and more particularly to the art of electrolessly plating metals, such as nickel and others.

Most materials and workpieces, whether metallic, semimetallic or non-metallic, can be electrolessly plated by employing plating solutions which contain metal ions and a reducing agent. In addition, the plating solutions generally contain substances and ions which form complexes with the metal ions, which assure the necessary stability of the bath, which act upon the structure of the plated metal coating (e.g. making the plating glossy) and which impart to the metal plating by incorporation therein a particular hardness and abrasive resistance or other characteristics. However, these substances and their reaction products, which are produced in the metallizing or plating process proper, as well as any substances which enter the bath in the course of normal production, can have a detrimental effect on the plating process, particularly when the plating bath has been operated for any length of time. The reaction products are the inherent result of the plating reaction between the necessary constituents of the plating solution. Other solid particles result from super-saturation which causes precipitation, and suspended particles from ordinary sources, e.g. dust. These reaction products, deposits and suspended particles (collectively hereinafter sometimes called "solid particles") have large surface areas and thus represent a great number of active nuclei on which undesirable plating reactions occur with the result of either spontaneous disintegration of the solution in the nature of a chain reaction or depletion of the chemicals required for the plating reactions. Such products of reaction, deposits and suspended particles can settle on the workpiece and result in an undesirably rough surface when the metal is plated thereover. It is therefore necessary to remove these solid particles by separating them from the solution on a continuous basis.

Presently known methods for commercially counteracting these shortcomings by removing the solid particles have proven to be either inadequate or unsatisfactory. If, for instance, conventionally used filters are employed as the separator, a phenomenon occurs which phenomenon is common to all electroless plating and involves deposition of the plating metal on the filter cloth or other filter inserts and on the filter cake. Moreover, the solid particles are frequently filterable only with great difficulty, so that in most cases auxiliary filtering accessories have to be employed. All these measures have in common the problem that the filtered-out solid particles, i.e., the filter cake, remains in contact with the plating solution and therefore continued depletion of the chemicals from the plating solution, bath disintegration and all the disadvantages associated therewith are encountered.

Since the plating operation is generally conducted at elevated temperatures close to the boiling point of the plating solution, attempts have also been made to overcome the depletion and other problems associated with the filtration of solid particles by cooling the solution before filtering and then reheating the baths for subsequent re-use. Such a procedure may be done intermittently, e.g. on a daily basis, which has the disadvantage of not providing constant solution properties for the entire operating period, or it can also be done by continuously cooling a portion of the bath for filtering. The latter procedure, however, is costly and therefore uneconomical.

It has also been suggested that the solid particles could be removed from the plating solution with the aid of gravity. This latter method employs centrifugal filtering, but centrifugal filtering also encounters the problems associated with ordinary filtering in that the plating solution is in constant contact with the filter cake, resulting in undesirable plating of the filter cake particles.

In addition to the undesired metallization and plating out onto the solid particles and filter cake as described above, metallization and plating out of the plating metal onto parts of the plating apparatus which come into contact with the plating bath solution, such as the plating solution container and auxiliary material and equipment, is a troublesome problem for the same reasons of chemical depletion and bath disintegration.

All such undesirable plating out, i.e. deposition of plating metal bath on solid particles and filter cake as described above, and on portions of the apparatus which come into contact with the plating solution are sometimes hereinafter and in the claims referred to as "random plating". "Free metal" refers to the metal which is deposited, either as random plating or, desirably, onto the article to be plated, from the metal ions in solution by the reduction thereof to the elemental metal.

The addition of anticatalytic substances to plating solutions does not prevent the undesirable metallization and plating of auxiliary materials and equipment parts coming in contact with the solution since the concentration of such anticatalytic substances has to be properly adapted to the optimal plating properties of the solution otherwise the desired plating of the workpiece would not be realized. In other words, there is a limit to the maximum permissible concentration of anticatalyst since an excessive concentration will so retard the plating reaction that the rate of plating onto the workpiece is insufficient. The term "anticatalyst" refers to substances such as lead ions which retard but do not completely stop the plating reaction so that plating of the bath container or other apparatus can be minimized while plating of the workpiece, i.e., the article to be plated, can proceed. The anticatalysts are also designated as stabilizing agents which are catalytic poisons (negativ catalyst) and which are added to the bath solution to control the rate of plating upon catalytic surfaces of the workpieces. This is disclosed in U.S. Pat. No. 2,763,723, granted on Sept. 11, 1956 to Paul Talmey and Gregoire Gutzeit as well as in U.S. Pat. No. 2,874,073, granted on Feb. 17, 1959 to Donald E. Metheny et al.

The present invention contemplates a new and improved process and apparatus which overcomes all the foregoing problems and others and provides a process or apparatus for electrolessly plating workpieces while minimizing the problem of rough plated surfaces associated with solid particles settling out on the workpiece and while minimizing the problems associated with random plating out on plating equipment which comes in contact with the plating solution.

The present invention provides a process and apparatus for electrolessly plating a metal, such as preferably nickel, from an aqueous plating solution which solution contains metal ions, e.g. nickel ions, reducible to free metal, a reducing agent (such as hypophosphite ions in the case of a nickel plating solution) and at least one anticatalytic substance, e.g. salts of lead, sulfur, antimony, chromium, etc. or any other substance disclosed in the above U.S. patents, and which solution can be continuously or intermittently treated in a separator, for the purpose of separating and removing from the solution solid particles suspended therein. The separator may be a filter and is preferably a centrifugal filter, i.e. centrifuge.

In accordance with the present invention, the plating solution contains anticatalytic substance in concentrations from about 0.000001 mol per liter to about 0.1 mol per liter (that is about $10^{-6}$ to about $10^{-1}$ mols per liter) and moving the apparatus relative to its supporting structure so that the plating solution is maintained at a speed relative to the plating apparatus parts with which it is in contact of more than about 0.9 meter per second. Naturally, in order to obtain desirable plating of free metal on the workpiece, the relative speed of plating solution to the workpiece may be any suitable speed substantially less than 0.9 meter per second.

The provision of the anticatalytic substance within the stated concentration limits, in combination with the minimum speed of relative movement of the solution to the plating apparatus with which it is in contact minimizes random plating out of the plating metal onto the apparatus and onto the solid particles suspended in the solution.

Reference herein and in the claims to the "plating apparatus" with which the solution is in contact, or words to that effect, includes the container holding the plating solution or parts of the container, as well as auxiliary equipment in contact with the solution, such as the filter.

Advantageously, a centrifuge is used for filtering the solution. If, however, stationary filters are employed, the circulation of the plating solution with the required relative speed with respect to the filter and to the plating equipment can be achieved by means of a rotating propeller or a hydrocyclone.

In accordance with one aspect of the invention, plating solution is treated to separate solid particles therefrom, and the treated plating solution, now substantially free of solid particles, is returned to the container holding the article to be plated. By practice of the invention, it is possible to withdraw the plating solution and to separate solid particles therefrom, preferably by centrifugal filtration, at substantially the plating temperature. By this it is meant that the plating solution need not be cooled by passage through a heat exchanger prior to the separation or filtration step, as is generally required in the prior art. Obviously, due to normal heat losses in passing the hot plating solution to the filter, an inherent slight cooling will occur. However, as used in the specification and in the claims, reference to passing the plating solution through the separator or filter "at substantially the plating temperature" means that the solution is not subjected to a deliberate heat exchange cooling step prior to being passed to the separator or filter.

In accordance with a more limited and preferred aspect of the invention, the apparatus for carrying out the process can be specially equipped with vibrators for achieving the required relative speed between the plating solution and the plating solution container or portions thereof and/or the filter.

In accordance with a further aspect of the present invention, the process is conducted in a continuous manner and is automatically controlled. To this end, the volume of solid particles in the plating solution is continuously measured and the portion of the bath to be conveyed through the filter is automatically controlled in dependence on this volume. The concentration of metal ions and of the anticatalytic substance in the plating solution can also be continuously monitored and the required additions can be suitably controlled in an automatic manner.

The principal object of the invention is to minimize the undesirable random plating on parts of the plating apparatus or to completely prevent such undesirable plating.

It is a further object of the present invention to minimize nucleation sites for the metal being plated at the filter cake surface, even if the filter cake covers an extensive area, and to minimize the problems associated with depletion by random plating of the chemicals required for the plating operation.

As is well known, anticatalytic substances include heavy metal ions and other ions, e.g. such as disclosed in the said U.S. patents. Conveniently, these are introduced into the bath solution in the form of common salts thereof. Suitable anticatalytic substances in accordance with the invention are added in the form of soluble salts or compounds of lead, antimony, bismuth, chromium, arsenic, cadmium, zinc, germanium, selenium, tin, mercury, tellurium, sulphur. Preferably, common organic and inorganic salts of the anticatalytic metals and common thiocompounds of sulphur are employed.

Other objects and advantages of the present invention will become apparent from the following description of a preferred embodiment together with the drawings forming a part thereof, wherein.

Figure 1:
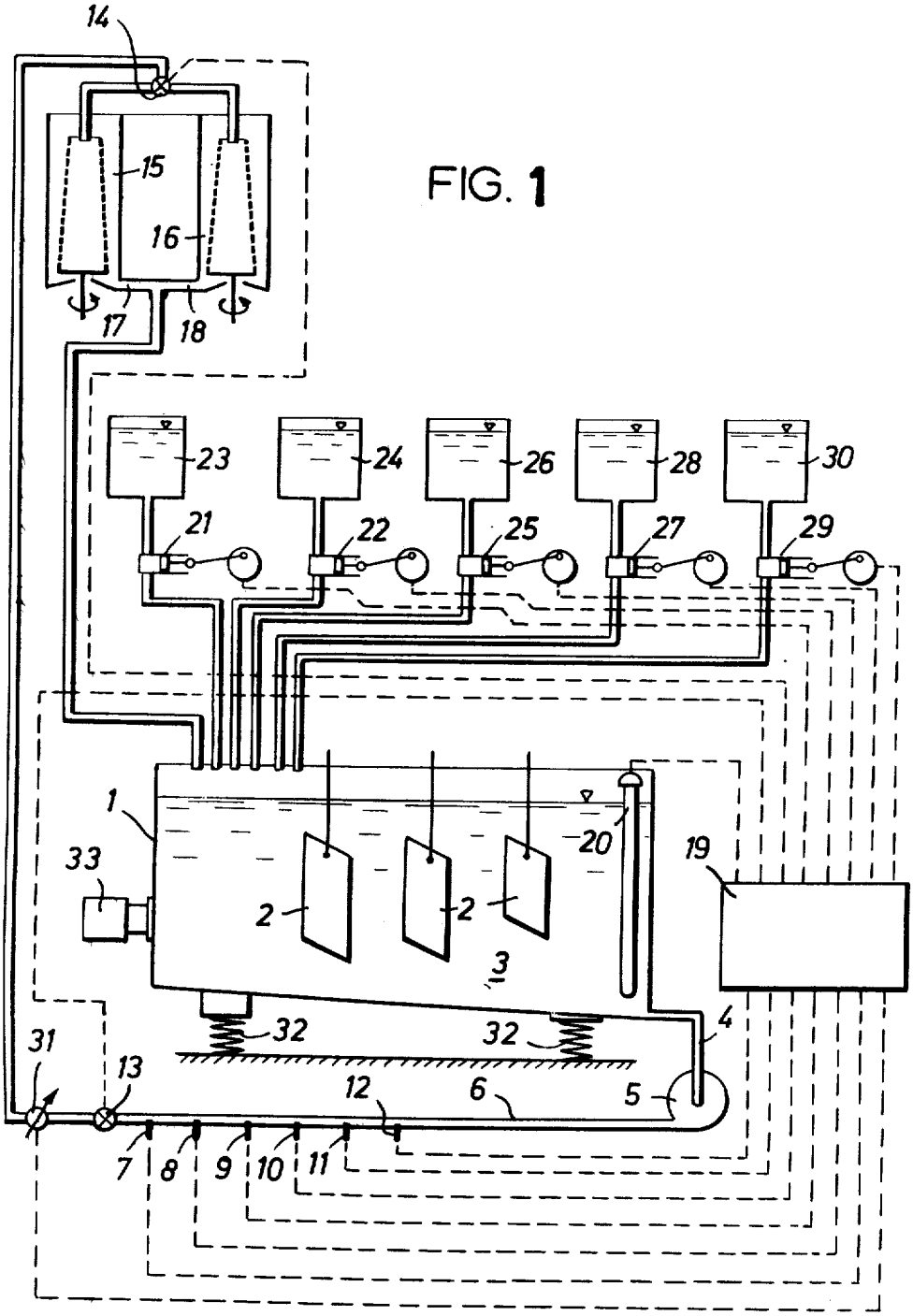
FIG. 1 is a schematic diagram of one embodiment of an apparatus adapted to carry out the present invention.

Referring now to FIG. 1, workpieces 2 to be plated are suspended in plating solution container 1. The plating solution 3 flows through conduit 4 to circulating pump 5 and from there through conduit 6 in which measuring probes 7, 8, 9, 10, 11 and 12 are installed for regulating valve 13. Through switchable three-way valve 14 the plating solution flows alternately into one of the two centrifuges 15 or 16 in which it is purified of suspended particles. The purified plating solution is then alternately returned to plating solution container 1 through discharge lines 17 or 18.

The measuring probes are monitors for measuring values of temperature 7, pH value 8, metal ion concentration 9, anticatalyst concentration 10, turbidity 11 and redox potential 12. The probes 7, 8, 9, 10, 11 and 12 are connected to process computer 19 which is programmed for optimum operation. The computer controls and regulates heating unit 20 for controlling the temperature of the bath, the dosing pumps 21 and 22 for the supply from the alkaline solution tank 23 and the acid container 24, respectively, the dosing pump 25 for the addition of metal ions from container 26, the dosing pump 27 for the addition of the anticatalyst solution from container 28, and the dosing pump 29 for the addition of the reducing agent from container 30. The process computer also monitors the degree of turbidity (measured by probe 11), the period of time used for the operation and the quantity measured by the volumetric meter 31 for switching over three-way valve 14 and thus determining the cleaning cycle for centrifuges 15 and 16. The container 1 rests on vibratory isolated supports 32 and has one or several oscillation generators 33 which set the container 1 vibrating to provide a relative speed of more than about 0.9 meter per second between the plating solution and the plating apparatus.

The process in accordance with the present invention can be successfully used for plating any metal which is electrolessly precipitable from aqueous solution by a reductant. Thus, the process can be employed when plating nickel, copper, brass, chrome, zinc, cadmium, tin, silver and other metals and can be conducted on a continuous and automatically controlled basis.

In continuous operation, the concentration of anticatalytic substances in the plating solution should be kept as constant as possible. The concentration of substances in the solution, which includes anticatalysts as well as metal ions and reductants, should, therefore, be monitored on a continuous basis during the operation. Continuous monitoring can be accomplished by any suitable means, e.g. photometrically by one or several photometers or electrometrically by potentiometers. The composition of the plating solution can be controlled and adjusted in response to the monitors by suitable devices coupled thereto, e.g. limiting regulators. The volume of solid articles contained in the plating bath can be continuously measured in a similar manner, e.g. with a flow turbidimeter, and an appropriate portion of the plating solution can be continuously withdrawn from the container and branched off with the help of control devices and regulators which are well known in the art. It is also desirable to continuously monitor and regulate the pH value, the redox potential and the temperature of the plating solution.

While it has long been known that certain substances have anticatalytic properties in electroless plating and tend to retard the rate of deposition of metal upon an object, it has been found that, surprisingly, the speed of the plating solution relative to the object upon which plating out occurs also affects the metal deposition rate i a predictable way.

For example, in Table I below there is set forth a series of nickel deposition rates measured at different concentrations of anticatalytic substance (in this case, lead ion) in solution and different flow speeds of the bath fluid relative to a wall surface.

TABLE I

| Solution speed relative to object upon which metal (nickel) is plated, meters per second (m/sec) | Rate of metal (nickel) deposition from solution on to object upon which metal is plated, micrometers per hour (μm/h) — Concentration of anticatalytic substance (lead ion) in solution, mols per liter (mol/l) | | | | | |
|---|---|---|---|---|---|---|
| | $10^{-6}$ | $10^{-5}$ | $10^{-4}$ | $10^{-3}$ | $10^{-2}$ | $10^{-1}$ |
| 0.11 | 23.1 | 20.6 | 15.8 | 11.0 | 6.1 | 0.5 |
| 0.27 | 22.6 | 18.8 | 14.7 | 10.9 | 5.2 | trace |
| 0.53 | 21.2 | 17.5 | 13.8 | 9.2 | 3.0 | trace |
| 0.80 | 17.6 | 14.0 | 9.8 | 7.1 | 2.0 | trace |
| 1.10 | 12.0 | 8.9 | 7.0 | 4.1 | 0.9 | trace |
| 1.60 | 4.8 | 3.3 | 1.9 | 1.6 | 0.1 | trace |
| 2.10 | 1.5 | 1.1 | trace | trace | trace | trace |

Figure 2:
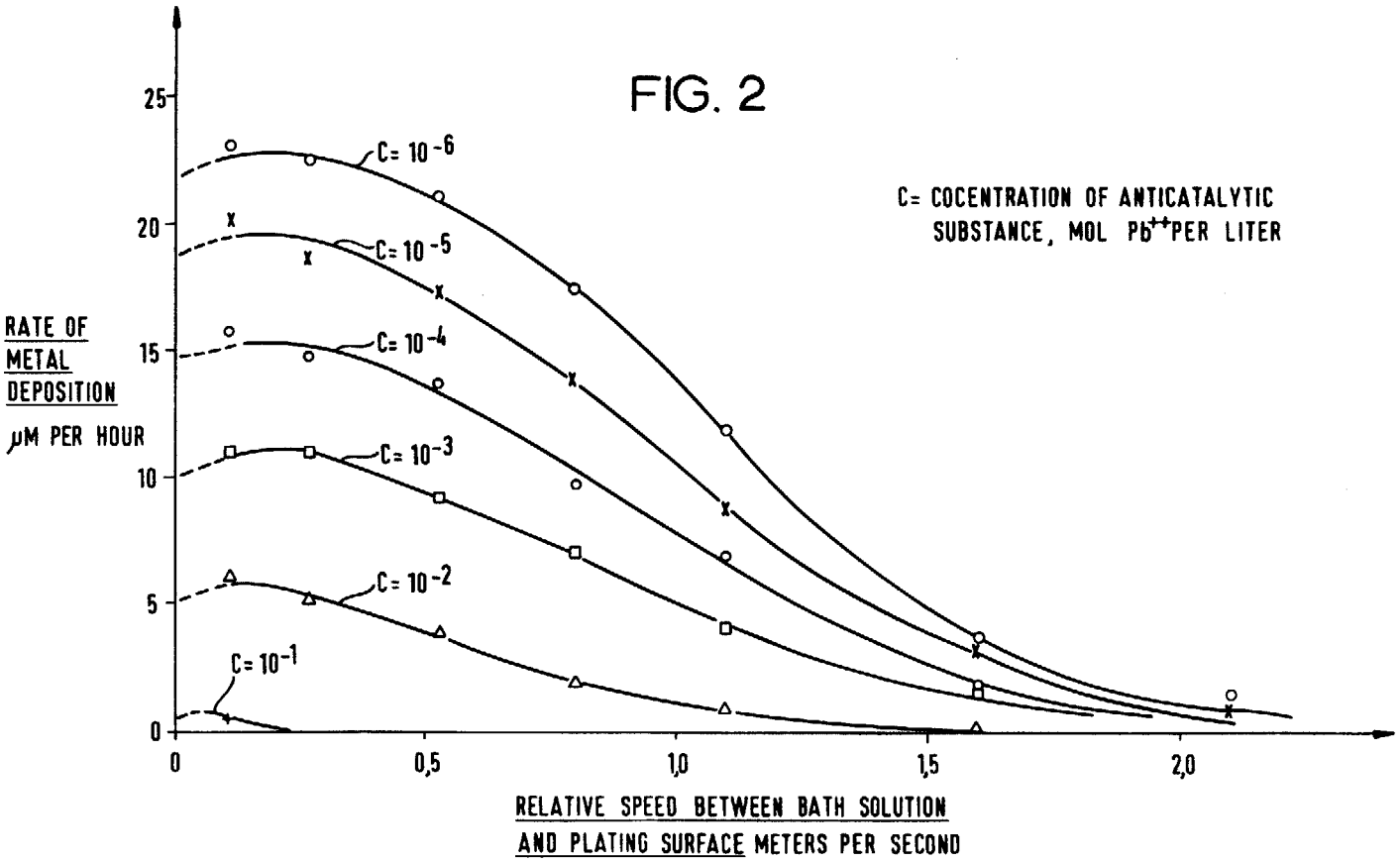
FIG. 2 is a graph which plots the rate of metal deposition against the speed of plating solution relative to an object being plated, as a function of the concentration of anticatalytic substance in the plating solution.

The data of Table I is plotted in FIG. 2 of the drawings. Referring now to FIG. 2, it is seen that the deposition speed of nickel decreases along a predictable smooth curve as the speed of the bath fluid flow relative to the object being plated increases. The absolute rates of nickel deposition vary with the concentration of lead ion in the solution but the general shape of the curves is seen to be similar at the various concentrations of anticatalytic substance.

At a flow speed of about 0.6 meter per second the rate of decrease of plating rate is seen to be very great. At about 1.2 meters per second flow speed the curves are seen to flatten and to approach zero asymptotically. At a speed midway between the speed (0.6 meters per second) at which the slope of the plating rate line begins to decrease rapidly and the speed (1.2 meters per second) at which the slope begins to flatten out, i.e. at about 0.9 meter per second, the solution speed begins to have a profound effect on the plating deposition rate. Even at the very slight anticatalytic substance concentration of $10^{-6}$ mols of lead per liter, the plating rate at 0.9 meters per second relative solution speed is only about 16 micrometers per hour, which is essentially a non-plating, for practical purposes, deposition rate.

While the test data given is for lead ion in solution as the anticatalytic substance, similar results are obtained with other anticatalysts, such as set forth in Table II.

TABLE II

| Anticatalysts | Concentrations of the anticatalysts in the plating solution ppm (parts per million) | Preferred concentrations of anticatalysts ppm | Added to the plating solution e.g. in the form of: |
|---|---|---|---|
| lead (Pb) | 0,5 – 50 | 1 – 20 | lead acetate $PbC_4H_6O_4$ or lead chloride $PbCl_2$ |
| zinc (Zn) | 1 – 500 | 50 – 150 | zinc chloride $ZnCl_2$ or zinc acetate $ZnC_4H_6O_4$ |
| cadmium (Cd) | 1 – 500 | 50 – 150 | cadmium chloride $CdCl_2$ |
| germanium (Ge) | 1 – 500 | 50 – 150 | germanium chloride $GeCl_4$ or germanium acetate $Ge(C_2H_3O_4)_2$ |
| arsenic (As) | 0,01 – 50 | 1 – 10 | arsenic (III) oxide $As_2O_3$ or arsenic pentoxide $As_2O_5$ |
| selenium (Se) | 1 – 100 | 30 – 60 | selenium oxide $SeO_2$ or selenious acid $H_2SeO_4$ |
| tin (Sn) | 10 – 200 | 30 – 70 | tin chloride $SnCl_2$ or tin fluoride $SnF_4$ |
| antimony (Sb) | 5 – 100 | 20 – 80 | antimony fluoride $SbF_3$ or antimony chloride $SbCl_3$ |
| bismuth (Bi) | 1 – 200 | 10 – 100 | bismuth chloride $BiCl_3$ or bismuth citrate $BiC_6H_5O_7$ |
| mercury (Hg) | 1 – 150 | 10 – 100 | mercury chloride $HgCl_2$ or mercury carbonate $Hg_2CO_3$ |
| tellurium (Te) | 0,5 – 100 | 10 – 50 | tellurium fluoride $TeF_4$ or |

TABLE II-continued

| Anticatalysts | Concentrations of the anticatalysts in the plating solution ppm (parts per million) | Preferred concentrations of anticatalysts ppm | Added to the plating solution e.g. in the form of: |
|---|---|---|---|
| chromium VI | 0,05 - 50 | 0,1 - 10 | orthotelluric acid $Te(OH)_6$ potassium chromate $KCrO_3$ or sodium bichromate $Na_2Cr_2O_7$ |
| sulphur (S) | 0,03 - 3,0 | — | if used as thiourea |
| sulphur (S) | 0,03 - 30 | — | if used as metal sulfide, e.g. sodium sulfide $Na_2S$ |

The data given in Table II for the concentration of the anticatalysts in the plating solution relate to plating solutions having a operating temperature between about 70° C and 95° C and having a pH between about 5 - 8. Of course, if the plating method is carried out at lower operating temperatures and/or at a lower pH the concentration of the anticatalysts is reduced correspondingly as this is well-known in the art. This in effect means that the concentration of anticatalytic substances lies between $10^{-6}$ and $10^{-1}$ mols per liter and, of course, the respective concentration is to be chosen according to the particular circumstances, namely the specific anticatalyst used in the solution, the operating temperature of the plating solution, the pH thereof and the like, as this is well-known.

When the concentration of anticatalytic substances is chosen in accordance with the specific kind and parameters of the plating process so as to obtain the desired plating rate and which concentration lies between $10^{-6}$ and $10^{-1}$ mols per liter for all anticatalytic substances and plating solutions, solution speeds of 0.9 meter per second or greater will maintain the random metal deposition rate below the value of 16 micrometers per hour. Naturally, it will be understood that in carrying out the process according to the invention, the workpiece to be plated are so arranged that the relative flow speed of the bath fluid to the workpieces is considerably less than the 0.9 meter per second in order that the desired plating out of metal on the workpieces may occur.

From a practical point of view, this result is best obtained by moving, by vibration or rotation, the container within which the article to be plated is immersed in the plating solution at a high enough speed to maintain the required minimum relative speed between the solution and the container. Instead of moving or vibrating the container as a whole parts of the container, which come into contact with the plating solution, such as wall portions or equipment parts of the container may be moved or vibrated to maintain the said relative speed.

Of course, it is possible to agitate and propel the solution in the container and through the apparatus by pumps, impellers or the like means to obtain the required minimum speed. (The use of such means to obtain the required solution speeds may be referred to as "hydrocylonic" means, the speeds being obtained "hydrocylconically".) In such cases, it is necessary to provide means such as damping plates or the like, which would hold the relative speed between the workpiece and the solution to well below 0.9 meter per second. However, this would require relatively complicated structure within the container and accordingly, it is preferred to vibrate or rotate the container or portions thereof to maintain the required relative speed between it and the solution. Such vibration or rotation can be carried out while maintaining the relative solution speed between the solution and the article to be plated to well below 0.9 meter per second.

Accordingly, this aspect of the invention consists of maintaining the flow speed of the plating solution relative to the apparatus, filters, auxiliary equipments or portions thereof at or, preferably, greater than 0.9 meter per second and, at the same time, maintaining the solution flow rate relative to the workpieces less than 0.9 meter per second. Irrespective of the specific anticatalyst used in the plating solution the concentration of the anticatalyst is maintained within the specified limits, that means between $10^{-6}$ and $10^{-1}$ mol per liter and within these limits the respective concentration of the anticatalytic substance is to be chosen in known manner in accordance to the respective anticatalyst used, the specific plating solution and the parameters of the plating process etc. so as to obtain the desired stabilizing effect and thereby the desired plating rate of the workpieces. As the stabilizing effect of the different anticatalytic substances is the same, random nickel plating upon the plating container and the other component parts of the system is essentially avoided irrespective of the specific anticatalytic substance used for the plating process. Therefore, all the anticatalytic substances will give the same results and, consequently, the curves shown in FIG. 2 will also be obtained if, instead of lead ions, other anticatalysts are used. In this manner desired plating out onto the workpieces occurs at an acceptably high rate whereas random plating and its attendant disadvantages on the equipment, filters, etc. is essentially avoided.

Relative speed between the separator and the plating solution is maintained at 0.9 meter per second or greater, preferably by employing a centrifuge or centrifugal filter as described above.

Although the present invention has been described in conjunction with a preferred embodiment, it is to be understood that modifications and variations may be resorted to without departing from the spirit and scope of the invention as those skilled in the art will readily understand. Such modifications and variations are considered to be within the purview and scope of the invention.

We claim:

1. An improved process for the electroless plating of a metal from an aqueous plating solution containing plating metal ions reducible to free metal, a reducing agent and an anticatalytic substance, the free metal depositing onto an article to be plated by being immersed into the plating solution contained in a container forming part of a suitable plating apparatus said apparatus including a supporting structure, while minimizng the random plating out of plating metal on those portions of the apparatus which come into contact with the plating solution, and maintaining an anticatalytic substance dissolved in the plating solution in concentrations from about 0.000001 mol per liter to about 0.1 mol per liter, the improvement consisting of: moving the apparatus relative to its supporting structure and said solution such as to maintain a relative speed of at least about 0.9 meter per second between the plating solution and portions of the container with which the plating solution comes into contact, while maintaining a relative speed of less than 0.9 meter per second between the plating solution and the article immersed therein in order to obtain proper plating of said article with the plating metal.

2. The process of claim 1, wherein the relative movement between the plating solution and those portions of the container with which it comes into contact is obtained by vibrating the container.

3. The process of claim 1, wherein the relative movement between the plating solution and those portions of the container with which it comes into contact is obtained by rotating the container.

4. The process of claim 1, in which the plating solution is drawn off from the container and is passed through a separator for the removal of solid particles suspended therein, and a relative speed of at least about 0.9 meter per second is maintained between the plating solution and those portions of the separator with which the plating solution comes into contact.

5. The process of claim 4 in which the separator is a centrifugal filter and the plating solution is centrifugally filtered by driving the centrifugal filter at a speed sufficient to maintain the stated relative speed between the plating solution and the centrifugal filter.

6. The process of claim 4 in which the plating solution is passed through the separator at substantially the plating temperature.

7. The process of claim 4, in which plating solution is continuously drawn off from the container and passed through the separator.

8. The process of claim 7, in which the volume of solid particles in the plating solution is continuously measured and the quantity of the plating solution drawn off from the container and passed to the separator is automatically controlled in response to the volume of solid particles contained in the plating solution.

9. The process of claim 1, in which a relative speed of at least 0.9 meter per second is maintained between the plating solution and those portions of the apparatus in contact with plating solution.

10. The process of claim 9, in which the relative speed between the plating bath and those portions of the apparatus in contact with plating solution is maintained hydrocyclonically.

11. The process of claim 9, in which the relative speed between the plating bath and those portions of the apparatus exposed to plating solution is maintained by vibrating the container holding the plating solution.

12. The process of claim 1, in which the concentrations of the metal ions and the anticatalytic substance are continuously measured and the required concentrations are automatically maintained.

13. The process of claim 1, in which the relative speed between the plating bath and those portions of the apparatus in contact with the plating solution is maintained hydrocyclonically.

14. The Process of claim 1, wherein said anticatalytic substance is an ion selected from the group of the following substances: sulphur, cadmium, zinc, germanium, arsenic, selenium, tin, antimony, lead, bismuth, mercury, tellurium, chromium.

15. The process of claim 1 wherein said metal is nickel.

* * * * *